US008781345B2

(12) United States Patent
Hitoshi

(10) Patent No.: US 8,781,345 B2
(45) Date of Patent: Jul. 15, 2014

(54) IMAGE FORMING APPARATUS AND METHOD OF FORMING IMAGE

(75) Inventor: Asaka Hitoshi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 558 days.

(21) Appl. No.: 13/090,475

(22) Filed: Apr. 20, 2011

(65) Prior Publication Data

US 2011/0262158 A1 Oct. 27, 2011

(30) Foreign Application Priority Data

Apr. 21, 2010 (JP) ..... 2010-097986
Feb. 7, 2011 (JP) ..... 2011-024202

(51) Int. Cl.
*G03G 15/00* (2006.01)

(52) U.S. Cl.
USPC ..... 399/43; 399/67; 399/68; 399/69; 399/388

(58) Field of Classification Search
CPC ..... G03G 15/6564; G03G 15/657; G03G 2215/00556
USPC ..... 399/43, 67, 68, 69, 388
See application file for complete search history.

(56) References Cited

U.S. PATENT DOCUMENTS

2003/0161648 A1* 8/2003 Nishiyama ..... 399/68
2007/0059008 A1* 3/2007 Iwasaki et al. ..... 399/68
2008/0003007 A1* 1/2008 Jang ..... 399/69
2008/0187341 A1 8/2008 Fujikura
2010/0040385 A1* 2/2010 Furuyama ..... 399/43

FOREIGN PATENT DOCUMENTS

JP 2008-158167 7/2008
JP 2008275833 A 11/2008
JP 2009276427 A * 11/2009

OTHER PUBLICATIONS

English Abstract JP 2009276427 A, Takeuchi, Nov. 2009.*

* cited by examiner

*Primary Examiner* — Ryan Walsh
(74) *Attorney, Agent, or Firm* — Frommer Lawrence & Haug LLP

(57) ABSTRACT

An image forming apparatus includes a fixing unit fixing toner images to paper sheets, a timing adjusting unit adjusting the timing of supplying paper sheets to the fixing unit, a temperature detecting unit detecting the temperature of a predetermined section of a heating rotating body included in the fixing unit, and a timing control unit selecting a first mode or a second mode immediately after start-up of the image forming apparatus in accordance with whether the number of paper sheets to be printed exceeds a predetermined number, wherein in the first mode, when the temperature detected by the temperature detecting unit exceeds a first temperature, the first paper sheet is supplied to the fixing unit and, in the second mode, when the detected temperature exceeds a second temperature different from the first temperature, the first paper sheet is supplied to the fixing unit.

17 Claims, 5 Drawing Sheets

IMAGE FORMING APPARATUS AND METHOD OF FORMING IMAGE

INCORPORATION BY REFERENCE

This application is based upon and claims the benefit of priority from the corresponding Japanese Patent application No. 2010-097986, filed Apr. 21, 2010, and Japanese Patent application No. 2011-024202, filed Feb. 7, 2011, the entire contents of which are incorporated herein by reference.

TECHNICAL FIELD

The present disclosure relates to an image forming apparatus, such as a printer, a copier, a facsimile, or a multi-functional peripheral that incorporates the functions thereof.

BACKGROUND

Image forming apparatuses according to the related art, such as printers, copiers, and multi-functional peripherals that incorporate the functions thereof, which are capable of printing (forming) images on transfer materials, such as paper sheets, are known. In general, an image forming apparatus fixes toner images onto paper sheets using a fixing unit, including a heating rotating body (heating roller) having a heater and a pressurizing rotating body (pressurizing roller) rotating while being pressed against the heating rotating body, by heating and pressing the paper sheets onto which the toner images have been transferred.

After power is turned on or after being in a stop state (e.g., power saving mode) for a long time, when such an image forming apparatus invokes printing an image on a first paper sheet, the image forming apparatus does not print the image on the first paper sheet immediately and waits until the fixing unit is heated to a predetermined temperature (a warm-up temperature) to print an image on the first paper sheet. Immediately after turning on power or resuming operation, the entire image forming apparatus is cool and the temperature of the fixing unit is significantly low. Therefore, when images are to be printed in sequence on multiple paper sheets, the temperature of the fixing unit may be lower than the temperature required to fix the images. Accordingly, the warm-up temperature set for known image forming apparatuses is generally high to include a margin in consideration of the temperature of the apparatus to be significantly low immediately after the power is turned on or operation is resumed. As a result, the warm-up time for the known image forming apparatuses, which is the time required to heat the apparatus to the warm-up temperature, is long.

Various methods of shortening the warm-up time of an image forming apparatus have been proposed. For example, an image forming apparatus that can print an image (perform image formation) on the first paper sheet in a significantly short amount of time by shortening the warm-up time in accordance with the thickness of the paper sheet have been known.

However, with such an image forming apparatus, merely the amount of time required to print an image on the first paper sheet is reduced. Therefore, when images are to be printed in sequence on multiple paper sheets, the amount of time required for printing the images in sequence after turning on power or resuming operation cannot be reduced.

SUMMARY

Some embodiments of the present disclosure relate to an image forming apparatus capable of fixing toner images on multiple paper sheets in a small amount of time when the toner images are to be printed in sequence on multiple paper sheets after turning on the power or after the apparatus has been in a stop state for a long time.

An image forming apparatus according to an aspect of some embodiments of the present disclosure includes an image forming unit configured to form toner images on transfer materials, a fixing unit configured to include a heating rotating body having a heater unit operable for heating the transfer materials and a pressurizing rotating body disposed adjacent to the hearing rotating body with a fixing nip therebetween and being configured for pressing the transfer materials supplied through the fixing nip. The fixing unit fixes the toner images formed at the image forming unit to the transfer materials by heating and pressing the transfer materials at the fixing nip. The fixing unit further includes a timing adjusting unit disposed upstream of the image forming unit in a conveying direction of the transfer materials and configured to adjust the timing of supplying the transfer materials to the fixing nip, a temperature detecting unit configured to detect a temperature of a predetermined section of the heating rotating body, a power supply unit configured to start or continue supplying electric power to the heater unit of the heating rotating body and a timing control unit configured to control the timing adjusting unit. The timing control unit selects a first mode or a second mode to be enabled in the event that the power supply unit starts supplying electric power to the heater unit of the heating rotating body. The first mode is the mode for controlling the timing adjusting unit to supply the first transfer material when the temperature of the predetermined section of the heating rotating body detected by the temperature detecting unit exceeds a first temperature. The second mode is the mode for controlling the timing adjusting unit to supply the first transfer material when the temperature of the predetermined section of the heating rotating body detected by the temperature detecting unit exceeds a second temperature different from the first temperature. And the timing control unit selects the first mode or the second mode in accordance with whether the number of transfer materials to be printed exceeds a predetermined number.

In accordance with some embodiments, an image forming apparatus includes an image forming unit configured to form toner images on transfer materials on the basis of the image-formation instruction information received by the receiving unit, a fixing unit configured to include a heating rotating body having a heater unit operable for heating the transfer materials and a pressurizing rotating body disposed adjacent to the heating rotating body with a fixing nip therebetween and being configured for pressing the transfer materials supplied through the fixing nip. The fixing unit fixes toner images formed at the image forming unit to the transfer materials by heating and pressing the transfer materials at the fixing nip. The fixing unit further includes a timing adjusting unit disposed upstream of the image forming unit in a conveying direction of the transfer materials and configured to adjust the timing of supplying the transfer materials to the fixing nip, a temperature detecting unit configured to detect a temperature of a predetermined section of the heat rotating body, a power supply unit configured to start or continue supplying electric power to the heater unit of the heating rotating body and a timing control unit configured to control the timing adjusting unit. The timing control unit selects a first mode or a second mode to be enabled in the event that the power supply unit starts supplying electric power to the heater unit of the heating rotating. The first mode is the mode for controlling the timing adjusting unit to supply the first transfer material when the temperature of the predetermined section of the heating rotating body detected by the temperature detecting unit exceeds a first temperature. The second mode is the mode for controlling the timing adjusting unit to supply the first transfer material when the temperature of the predetermined section of the heat rotating body detected by the temperature detecting unit exceeds a second temperature different from the first temperature. And when the number of transfer materials to be printed exceeds a predetermined number, the timing control unit controls the timing adjusting unit in the second mode up to the predetermined number of transfer materials and controls the timing adjusting unit in the first mode after the number of transfer materials exceeds the predetermined number.

In accordance with yet other embodiments, a method of forming an image using an image forming apparatus includes starting to supply electric power to a heater unit of a heating rotating body of a fixing unit that is operable to fix toner images onto transfer materials, determining the number of transfer materials to be printed and whether the number of transfer materials is smaller than or equal to a predetermined number, selecting between a first mode and a second mode based on whether the number of transfer materials exceeds the predetermined number, and starting printing on the transfer materials by controlling the timing of supplying transfer materials to the fixing unit in accordance with the selected mode. Here, the first mode is the mode for controlling the timing of supplying the first transfer material being printed to the fixing unit when a temperature of a predetermined section of the heating rotating body exceeds a first temperature and the second mode is the mode for controlling the timing of supplying the first transfer material being printed to the fixing unit when the temperature of the predetermined section of the heating rotating body exceeds a second temperature different from the first temperature.

The above and other objects, features, and advantages of various embodiments of the present disclosure will be more apparent from the following detailed description of embodiments taken in conjunction with the accompanying drawings.

In this text, the terms "comprising", "comprise", "comprises" and other founts of "comprise" can have the meaning ascribed to these terms in U.S. Patent Law and can mean "including", "include", "includes" and other forms of "include".

Various features of novelty which characterize various aspects of the disclosure are pointed out in particularity in the claims annexed to and forming a part of this disclosure. For a better understanding of the disclosure, operating advantages and specific objects that may be attained by some of its uses, reference is made to the accompanying descriptive matter in which exemplary embodiments of the disclosure are illustrated in the accompanying drawings in which corresponding components are identified by the same reference numerals.

BRIEF DESCRIPTION OF THE DRAWINGS

The following detailed description, given by way of example, but not intended to limit the disclosure solely to the specific embodiments described, may best be understood in conjunction with the accompanying drawings, in which.

DETAILED DESCRIPTION OF EMBODIMENTS

Reference will now be made in detail to various embodiments of the disclosure, one or more examples of which are illustrated in the accompanying drawings. Each example is provided by way of explanation of the disclosure, and is by no way limiting the present disclosure. In fact, it will be apparent to those skilled in the art that various modifications, combinations, additions, deletions and variations can be made to embodiments presented in the present disclosure without departing from the scope or spirit of the present disclosure. For instance, features illustrated or described as part of one embodiment can be used in another embodiment to yield a still further embodiment. It is intended that the present disclosure covers such modifications, combinations, additions, deletions, applications and variations that come within the scope of the appended claims and their equivalents.

Figure 1:
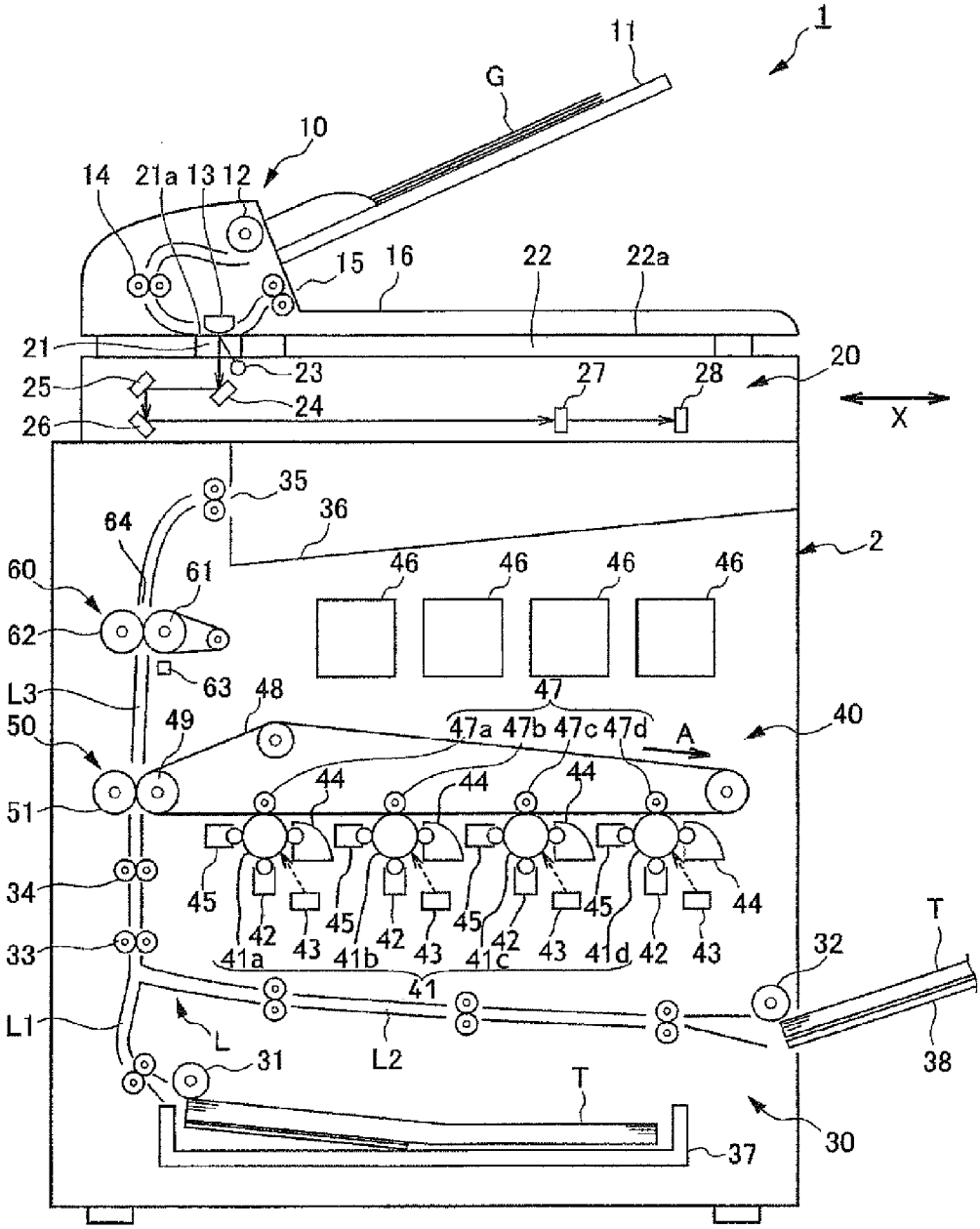
FIG. 1 illustrates an entire configuration of a copier as an example of an image forming apparatus according to some embodiments of the present disclosure.

A copier 1 as an example of an image forming apparatus according to an embodiment of the present disclosure will be described below with reference to the drawings. Particularly, FIG. 1 illustrates an entire configuration of the copier 1 as an example of the image forming apparatus according to this embodiment.

The copier 1 accommodates a copier main body 2, which forms (prints) color images on paper sheets T. The copier main body 2 includes a document conveying unit 10, a document reading unit 20, a sheet conveying unit 30, an image forming unit 40, a fixing unit 60, and a temperature detecting unit 63.

In this illustrative embodiment, the document conveying unit 10 is an automatic document feeder (ADF). The document conveying unit 10 includes a document placing unit 11, a first feeding roller 12, a guide 13, a timing roller pair 14, and a document ejecting unit 15. The first feeding roller 12 supplies, one by one, documents G (e.g., paper sheets) placed on the document placing unit 11 to the timing roller pair 14. The timing roller pair 14 starts and stops the conveying of the documents G to synchronize the timing of the document reading unit 20 starting to read the documents G and the timing of the documents G reaching the reading position (the position where the guide 13 is disposed) where the documents G are read by the document reading unit 20. The guide 13 guides the documents G to a first reading surface 21*a*, which is described below. The document ejecting unit 15 ejects the documents G (which have passed through the guide 13 to be read by the document reading unit 20) to the outside of the copier main body 2.

A document stacking unit 16 is disposed on the document ejecting unit 15 outside the copier main body 2. The documents G ejected from the document ejecting unit 15 are stacked on the document stacking unit 16.

The document reading unit 20 includes the first reading surface 21*a* and a second reading surface 22*a*. The first reading surface 21*a* is provided along the upper surface of a first contact glass 21 opposing the guide 13. A document G is read through the first reading surface 21*a*. The second reading surface 22*a* adjoins the first reading surface 21*a* (in FIG. 1, is disposed in a large area on the right to the first reading surface 21*a*). The second reading surface 22*a* is used to read a document (e.g., such as one of the documents G) without using the document conveying unit 10. The second reading surface 22*a* is disposed along the upper surface of a second contact glass 22 on which a document may be placed (e.g., manually), and a document so placed may be read through the second reading surface 22*a*.

The document reading unit 20 includes an illuminating unit 23, a first mirror 24, a second mirror 25, and a third mirror 26, an image-forming lens 27, and an imaging unit 28. The illuminating unit 23 and the first mirror 24 move in the sub-scanning direction X. The second mirror 25 and the third mirror 26 are disposed on the left of the illuminating unit 23 and the first mirror 24, as illustrated in FIG. 1. The second mirror 25 and the third mirror 26 move in the sub-scanning direction X while keeping a constant distance (light path length) between the first reading surface 21*a* or the second reading surface 22*a* and the imaging unit 28 via the first mirror 24, the second mirror 25, the third mirror 26, and the image-forming lens 27.

The illuminating unit 23 is a light source emitting light incident onto the document G. The first mirror 24, the second mirror 25, and the third mirror 26 are mirrors that guide light reflected at the document G to the image-forming lens 27 while maintaining a constant light path length. The image-forming lens 27 forms an image with the light from the third mirror 26 on the imaging unit 28. The imaging unit 28 includes a plurality of imaging devices aligned in the main scanning direction (i.e., the direction orthogonal to the sub-scanning direction X). The imaging devices acquire image data on the basis of the formed light images by converting the incident light into an electric signal and are, for example, charge-coupled devices (CCDs) or complementary metal-oxide-semiconductor (CMOS) image sensors.

The sheet conveying unit 30 includes a second feeding roller 31, a third feeding roller 32, an intermediate roller pair 33, a registration roller pair 34, which functions as a timing adjusting unit, and a sheet ejecting unit 35. A conveying path L through which paper sheets T (transfer materials) are conveyed includes a first conveying path L1, which is from the second feeding roller 31 to the intermediate roller pair 33, a second conveying path L2, which is from the third feeding roller 32 to the intermediate roller pair 33, and a third conveying path L3, which is from the intermediate roller pair 33 to the sheet ejecting unit 35.

The second feeding roller 31 feeds the paper sheets T held in a paper-feeding cassette 37 to the first conveying path L1. The third feeding roller 32 feeds the paper sheets T placed on a manual feeding tray 38 to the second conveying path L2. The intermediate roller pair 33 are disposed upstream of the registration roller pair 34 in the conveying direction of the paper sheets T and, together with the registration roller pair 34, bend the paper sheets T.

The registration roller pair 34 is disposed upstream of the image forming unit 40 in the conveying direction of the paper sheets T and conveys the paper sheets T and stops the conveying of the paper sheets T to synchronize the timing of images being formed in the image forming unit 40 and the timing of supplying the paper sheets T to the image forming unit 40. The registration roller pair 34 correct skew (skew feeding) of the paper sheets T.

The sheet ejecting unit 35 ejects the paper sheets T on which toner images have been fixed to outside the copier main body 2. An ejected-sheet stacking unit 36 is disposed on the outer side of the copier main body 2, as viewed from the sheet ejecting unit 35. The paper sheets T ejected from the sheet ejecting unit 35 are stacked on the ejected-sheet stacking unit 36.

In accordance with the illustrative embodiment, the image forming unit 40 includes photoreceptor drums 41, charging units 42, laser scanner units 43, developers 44, cleaning units 45, toner cartridges 46, primary transfer rollers 47, an intermediate transfer belt 48, an opposing roller 49, and a transfer unit 50.

The photoreceptor drums 41 (41*a*, 41*b*, 41*c*, and 41*d*) function as photoreceptors or image carriers to form toner images of black, cyan, magenta, and yellow, respectively. The charging units 42, the laser scanner units 43, the developers 44, and the cleaning units 45 are disposed around the respective photoreceptor drums 41*a*, 41*b*, 41*c*, and 41*d* from upstream to downstream in the rotational direction of the photoreceptor drums 41. The charging units 42 electrically charge the surfaces of the photoreceptor drums 41. The laser scanner units 43 are detached from the surfaces of the photoreceptor drums 41 and scan and expose the surfaces of the photoreceptor drums 41 with the light on the basis of image data associated with a document G read by the document reading unit 20. In this way, electrostatic latent images are formed on the surfaces of the photoreceptor drums 41 by eliminating charges from the exposed areas. The developers 44 form toner images by attaching toner to the areas from which the charges have been eliminated (i.e., the exposed areas) in the electrostatic latent images formed on the surfaces of the photoreceptor drums 41. The cleaning units 45 remove the toner remaining on the surfaces of the photoreceptor drums 41 after the surfaces are neutralized by a neutralizer (not shown).

The toner cartridges 46 accommodate the different-color toners to be supplied to the respective developers 44. The respective toner cartridges 46 and the respective developers 44 are connected by toner supply channels (not shown).

The primary transfer rollers 47 (47*a*, 47*b*, 47*c*, and 47*d*) are disposed opposite to the photoreceptor drums 41*a*, 41*b*, 41*e*, and 41*d* with the intermediate transfer belt 48 interposed therebetween. The intermediate transfer belt 48 passes through the image forming unit 40. The toner images formed on the surfaces of the photoreceptor drums 41*a*, 41*b*, 41*c*, and 41*d* are transferred to the intermediate transfer belt 48 through primary transfer. The opposing roller 49 is disposed inside the annular intermediate transfer belt 48 and functions as a driving roller that moves the intermediate transfer belt 48 in the direction indicated by arrow A in FIG. 1.

The transfer unit 50 includes a secondary transfer roller 51. The secondary transfer roller 51 is disposed opposite to the opposing roller 49 with the intermediate transfer belt 48 interposed therebetween and nips part of the intermediate transfer belt 48 with the opposing roller 49. The secondary transfer roller 51 transfers the primary transfer toner images on the intermediate transfer belt 48 to the paper sheets T by secondary transfer.

The fixing unit 60 is disposed downstream of the image forming unit 40 in the conveying direction of the paper sheets T and includes a heating rotating body 61 and a pressurizing rotating body 62. The heating rotating body 61 heats the paper sheets T. The pressurizing rotating body 62 is disposed opposite to the heating rotating body 61. A fixing nip 64 is formed between the heating rotating body 61 and the pressurizing rotating body 62. The paper sheets T on which toner images have been formed by secondary transfer enter the fixing nip 64 between the heating rotating body 61 and the pressurizing rotating body 62, where the toner is melted and pressurized to be fixed onto the paper sheets T.

In some embodiments, the temperature detecting unit 63 includes, for example, a thermistor to directly or indirectly detect a temperature of a predetermined section of the heating rotating body 61 (for example, a section on the circumferential surface of the heating rotating body 61 corresponding to the fixing nip 64 (referred to herein for convenience as "nip associated section")). In general, it may be difficult to directly detect the temperature of the nip associated section due to factors such as the structure of the heating rotating body 61. Accordingly, in some embodiments such as the present illustrative embodiment, the temperature detecting unit 63 is in contact with a section on the circumferential surface of the heating rotating body 61 excluding the nip associated section (for example, the temperature detecting unit may be in contact with the section on the circumferential surface of the heating rotating body 61 upstream of the nip associated section in the rotating direction of the heating rotating body 61) and indirectly detects the temperature of the nip associated section of the heating rotating body 61.

Although not described in detail, the various rollers disposed in the copier 1 (the first feeding roller 12, the timing roller pair 14, the second feeding roller 31, the third feeding roller 32, the intermediate roller pair 33, the registration roller pair 34, the primary transfer rollers 47, the opposing roller 49, and the secondary transfer roller 51) are driven by a driver not shown in the drawing.

Figure 2:
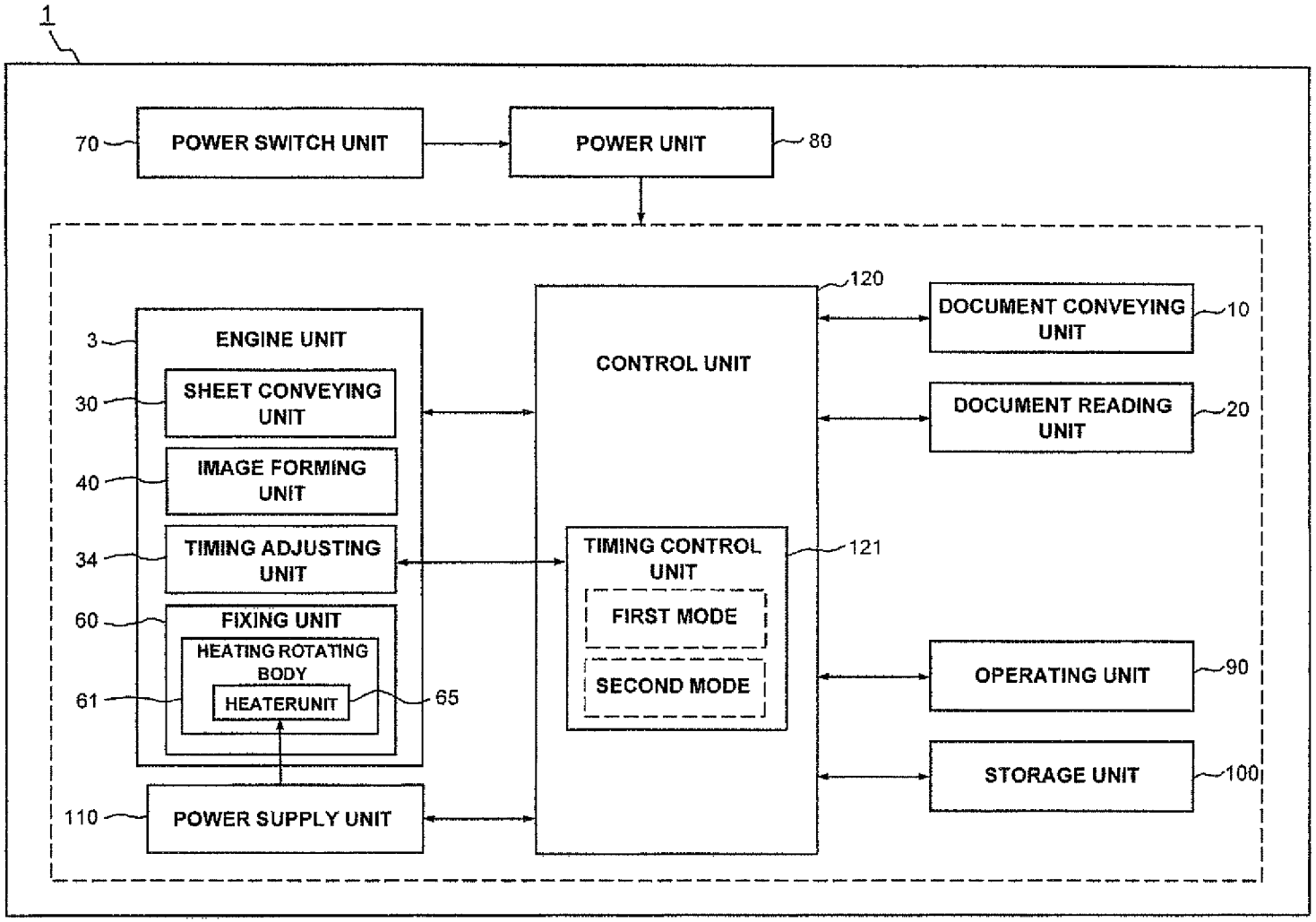
FIG. 2 is a block diagram illustrating the functional configuration of the copier, in accordance with some embodiments of the present disclosure.

A functional configuration of the copier 1 according to some embodiments will be described below. FIG. 2 is a block diagram illustrating an embodiment of the functional configuration of the copier 1.

In this illustrative embodiment, the copier 1 includes the document conveying unit 10, the document reading unit 20, and an engine unit 3. The engine unit 3 includes the sheet conveying unit 30, the image forming unit 40, and the fixing unit 60, which are described above. Descriptions of components in FIG. 2 that are described with reference to FIG. 1 are omitted for clarity of exposition. The copier 1 includes, in addition to the above described components, a power switch unit 70, a power unit 80, an operating unit 90 as a receiving unit, a storage unit 100, a power supply unit 110, and a control unit 120.

The power switch unit 70 is operated to turn on and off the main power source of the copier 1. Specifically, the power switch unit 70 enables the power unit 80 to switch between an on state and an off state.

The power unit 80 supplies electric power to the copier 1. The power unit 80 transfers to the on state from the off state or to the off state from the on state when the power switch unit 70 is operated. The off state includes a sleep mode. That is, an off-operation to move a state of the copier 1 to the off state from the on state includes an automatic power-off to automatically move the state of the copier 1 to the off state after a predetermined amount of time. An on operation to move the state of the copier 1 to the on state from the off state includes an on operation of the power switch unit 70 in the sleep mode. In this embodiment, the switching from the off state to the on state of the power unit 80 turning on (i.e., the copier 1 is switched from the off state to the on state) is referred to as "a starting up," and the amount of time required for the copier 1 to reach a stable state from the start-up is referred to as the "start-up time" of the copier 1.

The operating unit 90 includes ten keys (not shown), a touch panel (not shown), and a start key (not shown), or the like. The ten keys are operated to input numbers, such as the number of printed copies to be made. The touch panel displays keys which are respectively assigned to various functions (for example, a function for setting the printing magnitude and a function for assigning a plurality of pages to one paper sheet T). Each of the keys displayed on the touch panel is operated (touched) to execute one of the various functions of the copier 1. The start key is operated to carry out printing (copying). When one of the keys on the operating unit 90 is operated, the operating unit 90 supplies a signal representing the operation of the key ("image-formation instruction information") to the control unit 120.

The storage unit 100 includes one or more storage media of the same or different types, such as a hard disk, a semiconductor memory, or the like. The storage unit 100 stores image data based on documents G read by the document reading unit 20. The storage unit 100 stores control programs used by the copier 1 and data used by such control programs. In the present embodiment, the storage unit 100 stores, for example, control programs and various data items used to realize a first mode and a second mode, which are described below.

In the illustrative embodiment, the heating rotating body 61 accommodates a heater unit 65. The heater unit 65 includes, for example, a halogen heater, or a ceramic heater, or the like. The heater unit 65 is disposed inside the heating rotating body 61, along the rotary shaft thereof. Thus, the heating rotating body 61 is heated from the inside by the heater unit 65. The power supply unit 110 supplies electric power to the heater unit 65, which is included in the heating rotating body 61, on the basis of the control by the control unit 120. The power supply unit 110 starts or continues to supply electric power to the heater unit 65 on the basis of a signal supplied to the control unit 120 in response to operation of the operating unit 90. Specifically, when the operating unit 90 is operated, the control unit 120 controls the power supply unit 110 to start or continue supplying electric power to the heater unit 65. The power supply unit 110 starts supplying electric power to the heater unit 65 when the copier 1 is started up. Specifically, when the power switch unit 70 is turned on to turn on the power unit 80, the control unit 120 controls the power supply unit 110 to start supplying electric power to the heater unit 65.

The control unit 120 controls the document conveying unit 10, the document reading unit 20, the engine unit 3, the operating unit 90, and so on.

An example of the function (operation) of the control unit 120 according to some embodiments will be described below for a case in which documents G placed on the document placing unit 11 are copied. First, the control unit 120 detects operation of the start key, which is included in the operating unit 90, which supplies a signal representing that the start key is operated to the control unit 120. Then, the control unit 120 drives the first feeding roller 12 of the document conveying unit 10 to supply the documents G to the first reading surface 21*a*. The control unit 120 controls the document reading unit 20 to generate image data based on the documents G supplied to the first reading surface 21*a* and temporarily stores the generated image data in the storage unit 100. The control unit 120 controls the sheet conveying unit 30, the image forming unit 40, and the fixing unit 60, which are included in the engine unit 3, to form toner images on paper sheets T on the basis of the image data temporarily stored in the storage unit 100. Specifically, the control unit 120 provides controls signals operative for driving the second feeding roller 31 or the third feeding roller 32 to convey the paper sheets T to the transfer unit 50. The control unit 120 supplies to the laser scanner units 43 color image data items generated for the different colors on the basis of the image data and causes electrostatic latent images to be formed on the respective photoreceptor drums 41 for the different colors using laser beams emitted from the respective laser scanner units 43. The control unit 120 controls the formation of toner images on the respective photoreceptor drums 41 by the respective developers 44 and the primary transfer of the respective toner images onto the intermediate transfer belt 48. The control unit 120 is also operable to control the secondary transfer of the toner images on the intermediate transfer belt 48 onto the paper sheets T by the secondary transfer roller 51. The control unit 120 controls the power supply unit 110 to heat the heating rotating body 61 to a predetermined temperature to melt the toner of the toner images transferred onto the paper sheets T by the heating rotating body 61 and fix the toner to the paper sheets T by the pressurizing rotating body 62 pressed against the heating rotating body 61. The control unit 120 further controls ejection of the paper sheets T on which the toner images are fixed from the sheet ejecting unit 35 by the sheet conveying unit 30.

An illustrative characteristic control by the control unit 120 according to some embodiments such as the present embodiment will be described below. The control unit 120 includes a timing control unit 121.

The timing control unit 121 controls the registration roller pair 34 to adjust the timing of supplying the paper sheets T to the image forming unit 40 and the fixing unit 60 (i.e., the timing of supplying the paper sheets T to the fixing nip 64). Immediately after starting up the copier 1, the timing control unit 121 controls the registration roller pair 34 in the first mode or the second mode, which are described below.

Figure 3A:
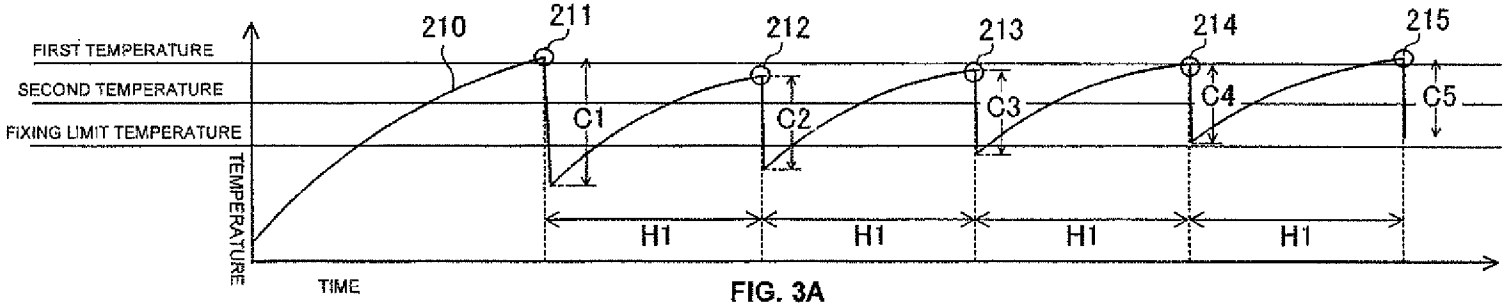
FIGS. 3A to 3C are timing charts illustrating temperature variations in a heat rotating body after power of the copier is turned on or operation is resumed, in accordance with some embodiments of the present disclosure.
Figure 3B:
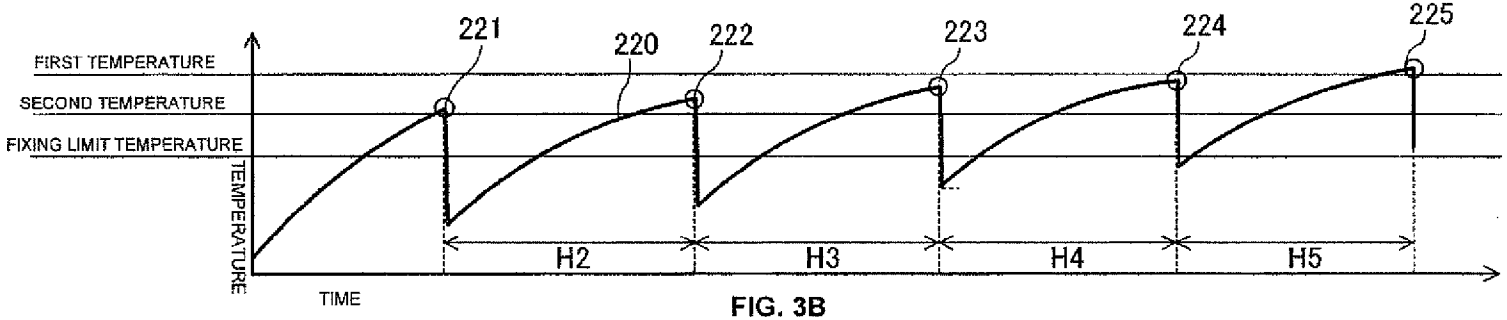
Figure 3C:
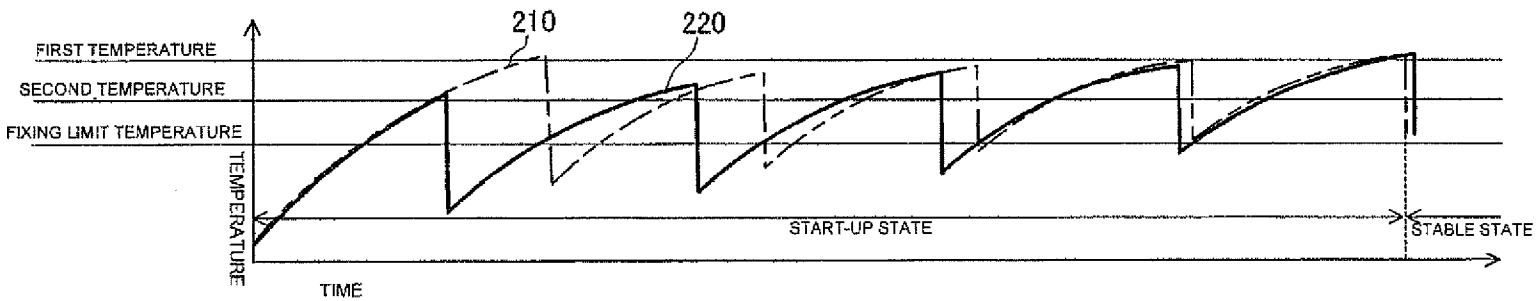

With reference to FIGS. 3A to 3C, the first mode and the second mode implemented by the timing control unit 121 in accordance with some embodiments will be described below. FIGS. 3A to 3C are timing charts illustrating temperature variations of a predetermined section on the surface of the heating rotating body 61 immediately after starting up the copier 1 or resuming operation. FIG. 3A is a timing chart illustrating the temperature variation of the predetermined section on the surface of the heating rotating body 61 when the registration roller pair 34 is controlled based on the first mode. FIG. 3B is a timing chart illustrating the temperature variation of the predetermined section on the surface of the heating rotating body 61 when the registration roller pair 34 is controlled based on the second mode. FIG. 3C is a timing chart comparing the first mode and the second mode.

With reference to FIG. 3A, the first mode according to some embodiments will be described. In FIGS. 3A to 3C, the horizontal axis represents time, and the vertical axis represents the temperature of the predetermined section on the surface of the heating rotating body 61. As a result of the power supply unit 110 starting to supply electric power to the heater unit 65 immediately after the copier 1 is started up, a temperature of the predetermined section on the surface of the heating rotating body 61 rises to match a prescribed temperature rising curve. The curve 210 represents a temperature variation of the predetermined section on the surface of the heating rotating body 61 in the first mode. In FIG. 3A, the temperature of the surface of the heating rotating body 61 decreases immediately after points 211, 212, 213, 214, and 215. The changes at these points represents the temperature of the surface of the heating rotating body 61 decreasing as a result of the paper sheets T being supplied to the fixing unit 60 (fixing nip 64). That is, each of the paper sheets T supplied to the fixing unit 60 contacts the heating rotating body 61 and draws heat from the surface of the heating rotating body 61, causing the temperature of the heating rotating body 61 to drop. Here, the points 211, 212, 213, 214, and 215 represents the moments that successive paper sheets T are supplied to the fixing unit 60. More specifically, the point 211 represents the moment the first paper sheet T is supplied to the fixing unit 60 after the copier 1 is started up; the point 212 represents the moment the second paper sheet T is supplied to the fixing unit 60; the point 213 represents the moment the third paper sheet T is supplied to the fixing unit 60; the point 214 represents the moment the fourth paper sheet T is supplied to the fixing unit 60; and the point 215 represents the moment the fifth paper sheet T is supplied to the fixing unit 60.

As a result of the paper sheets T being supplied to the fixing unit 60, the temperature drop of the predetermined section on the surface of the heating rotating body 61 is greatest immediately after the copier 1 is started up when the entire copier 1 is cool and becomes smaller as the entire copier 1 becomes warmer by the heat from the heated parts such as the fixing unit 60, etc. Specifically, in FIG. 3A, the temperature drop C1 resulting from the first paper sheet T being supplied to the fixing unit 60 is the greatest; the temperature drop C2 resulting from the second paper sheet T being supplied to the fixing unit 60 is the second greatest; the temperature drop C3 resulting from the third paper sheet T being supplied to the fixing unit 60 is the third greatest; the temperature drop C4 resulting from the fourth paper sheet T being supplied to the fixing unit 60 is the fourth greatest; and the temperature drop C5 resulting from the fifth paper sheet T being supplied to the fixing unit 60 is the smallest.

After a predetermined amount of time elapses after starting up the copier 1, the temperature of the entire copier 1 becomes substantially constant (sufficient heat is applied and stored), and the temperature drop of the predetermined section on the surface of the heating rotating body 61 as a result of the paper sheets T being supplied to the fixing unit 60 also becomes substantially constant. Hereinafter, for ease of reference and clarity of exposition, the state in which the temperature drop of the predetermined section on the surface of the heating rotating body 61 as a result of the paper sheets T being supplied to the fixing unit 60 is substantially constant is referred to as a "stable state." The amount of time required for the copier 1 to enter a stable state after start-up depends on the type of the copier 1. By way of example, the copier 1 of the present illustrative embodiment enters a stable state after the moment the fifth paper sheet T is supplied to the fixing unit 60 after start-up in the first mode. Specifically, the copier 1 of the present embodiment is in a start-up state until the fifth paper sheet T is supplied to the fixing unit 60 after start-up and enters a stable state after the fifth paper sheet T is supplied to the fixing unit 60.

In the first mode, in response to the temperature of the predetermined section on the surface of the heating rotating body 61 reaching a first temperature higher than the fixing limit temperature of the fixing unit 60, the timing control unit 121 controls the registration roller pair 34 to supply the first paper sheet T to the fixing unit 60. Then, in response to a prescribed amount of time H1 (corresponding to a "first amount of time") elapsing from the moment the previous paper sheet T has been supplied to the fixing unit 60, the timing control unit 121 controls the registration roller pair 34 to supply the second and subsequent paper sheets T to the fixing unit 60. The fixing limit temperature is the lower limit of the temperature required for fixing the toner images transferred on the paper sheet T onto the paper sheet T. Therefore, when a paper sheet T is supplied to the fixing unit 60 at a temperature of the predetermined section on the surface of the heating rotating body 61 lower than the fixing limit temperature, a fixing failure due to lack of heating may occur.

With reference to FIG. 3B, the second mode according to some embodiments will be described. The curve 220 represents the temperature variation of a predetermined section on the surface of the heating rotating body 61 in the second mode. Points 221, 222, 223, 224, and 225 respectively represent the timing of supplying the first paper sheet T, the second paper sheet T, the third paper sheet T, the fourth paper sheet T, and the fifth paper sheet T to the fixing unit 60 (fixing nip 64).

In the second mode, in response to a temperature of the predetermined section on the surface of the heat rotating body 61 reaching a second temperature lower than the first temperature and higher than the fixing limit temperature of the fixing unit 60, the timing control unit 121 controls the registration roller pair 34 to supply the first paper sheet T to the fixing unit 60. In this way, in the second mode, since the first paper sheet T is supplied to the fixing unit 60 at a temperature lower than the first mode, the paper sheet T is supplied to the fixing unit 60 at a timing earlier than the first mode.

In the second mode, as a result of supplying the first paper sheet T to the fixing unit 60 at an early timing, the temperature of the predetermined section on the surface of the heating rotating body 61 after the first paper sheet T is supplied is lower than that in the first mode. Therefore, in the second mode, in response to a prescribed amount of time H2 (corresponding to a "second amount of time"), which is greater than the amount of time H1, elapsing from the moment the first paper sheet T has been supplied, the timing control unit 121 controls the registration roller pair 34 to supply the second paper sheet T to the fixing unit 60 (the fixing nip 64). Then, in response to a prescribed amount of time H3 (corresponding to a "third amount of time"), which is greater than the amount of time H1 and smaller than the amount of time H2, elapsing from the moment the second paper sheet T has been supplied, the timing control unit 121 controls the registration roller pair 34 to supply the third paper sheet T to the fixing unit 60. In response to a prescribed amount of time H4 (corresponding to a "fourth amount of time"), which is greater than the amount of time H1 and smaller than the amount of time H3, elapsing from the moment the third paper sheet T has been supplied, the timing control unit 121 controls the registration roller pair 34 to supply the fourth paper sheet T to the fixing unit 60. In response to a prescribed amount of time H5 (corresponding to a "fifth amount of time"), which is greater than the amount of time H1 and smaller than the amount of time H4, elapsing from the moment the fourth paper sheet T has been supplied, the timing control unit 121 controls the registration roller pair 34 to supply the fifth paper sheet T to the fixing unit 60. In the second mode, the timing control unit 121 controls the registration roller pair 34 such that the successive time intervals (following the supplying of the first paper sheet T) of supplying the second and subsequent paper sheets T to the fixing unit 60 monotonically (and, e.g., gradually) decrease to the amount of time H1.

In the second mode, since the first paper sheet T is supplied to the fixing unit 60 at a timing earlier than the first mode and the second and subsequent paper sheets T are supplied to the fixing unit 60 in time intervals longer than the first mode, the paper sheets T are supplied to the fixing unit 60 at timings earlier than the first mode after start-up of the copier 1 until a predetermined number of paper sheets reach the fixing unit 60. In FIG. 3C, according to the present illustrative embodiment, in the second mode, the first to fourth paper sheets T are supplied to the fixing unit 60 at timings earlier than the first mode, and the fifth paper sheet T is supplied to the fixing unit 60 at a timing later than the first mode. Accordingly, the second mode is advantageous when the number of paper sheets T to be printed is small when the copier 1 is started up. Specifically, when a small number (four or less in the present embodiment) of copies are to be printed quickly, the copies can be prepared faster in the second mode than the first mode, providing convenience.

In the first mode, since the first paper sheet T is supplied to the fixing unit 60 in response to the temperature of the heat rotating body 61 reaching a sufficiently high first temperature, the temperature of the heat rotating body 61 can be appropriately maintained for the second and subsequent paper sheets T being supplied. In the first mode, since the second and subsequent paper sheets T are supplied to the fixing unit 60 in response to the prescribed amount of time H1, which is a smaller than that in the second mode, elapsing, the fifth paper sheet T is supplied to the fixing unit 60 at a timing earlier than the second mode. Therefore, the first mode is advantageous when a large number of paper sheets T is to be printed immediately after the copier 1 is started up. Specifically, when a large number (five or more in the present embodiment) of copies are to be printed quickly, the copies can be prepared faster in the first mode than the second mode, providing convenience.

Returning to FIG. 2, the timing control unit 121 enters the first mode or the second mode in accordance with the print-copies information, which is information indicative of the number of paper sheets T to be printed (copies to be printed), supplied from the operating unit 90 immediately after the copier 1 is started up. Specifically, in accordance with some embodiments, immediately after the copier 1 is started up, the timing control unit 121 enters the first mode when the number of the paper sheets T to be printed exceeds a predetermined number and enters the second mode when the number is smaller than or equal to the predetermined number. It is understood that this is essentially identical to the timing control unit 121 entering the first mode when the number of the paper sheets T to be printed immediately after the copier 1 is started up is equal to or exceeds a certain predetermined number and enters the second mode when the number is smaller than the certain predetermined number, the difference only being that the certain predetermined number would be a threshold value that is one greater than the predetermined number referred to in the previous sentence. In the present illustrative embodiment, the timing control unit 121 enters the first mode when the number of paper sheets T to be printed immediately after the copier 1 is started up exceeds four and enters the second mode when the number of the paper sheets T to be printed immediately after the copier 1 is started up is smaller than or equal to four.

In accordance with some embodiments, in a stable state after start-up, the timing control unit 121 controls the registration roller pair 34 to supply the next paper sheet T to the fixing unit 60 in response to a predetermined amount of time (for example, the prescribed amount of time H1) elapsing from the moment the previous paper sheet T has been supplied to the fixing unit 60.

Figure 4:
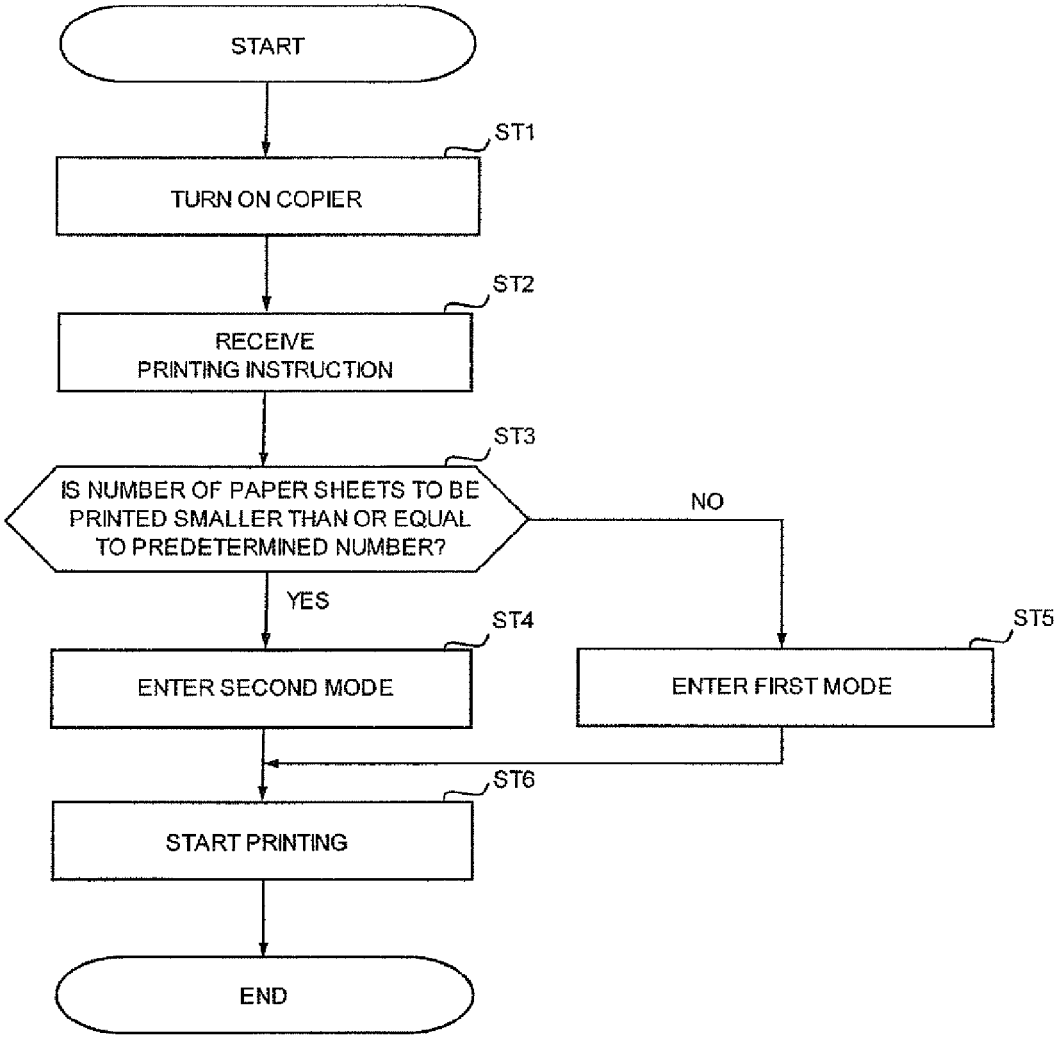
FIG. 4 is a flow chart illustrating the operation control of the copier, in accordance with some embodiments of the present disclosure.

With reference to FIG. 4, an illustrative characteristic operation of the copier 1 according to some embodiments will be described below. FIG. 4 is a flow chart illustrating the processing flow of the control unit 120 of the copier 1. In FIG. 4, only the processing flow of the control unit 120 immediately after the copier 1 is started up is illustrated, and the processing flow of the control unit 120 after the copier 1 enters a stable state is not illustrated.

In block ST1, the control unit 120 turns on the power unit 80 (copier 1) from the power-off state in response to the operation of the power switch unit 70. At this time, the control unit 120 controls the power supply unit 110 to start supplying electric power to the heater unit 65.

Subsequently, in block ST2, the control unit 120 receives a printing instruction (image-formation instruction information) from the operating unit 90. The printing instruction includes print-copies information indicative of the paper sheets T to be printed, which may be set using the ten keys. Specifically, the control unit 120 (timing control unit 121) recognizes, based on the print-copies information, the product of the number of documents read by the document reading unit 20 and the number of copies to be printed indicated by the print-copies information as the number of paper sheets T to be printed. In block ST3, the control unit 120 determines whether the number of paper sheets T to be printed is smaller than or equal to a predetermined number. For example, when the number of paper sheets T to be printed is smaller than or equal to four, the control unit 120 (timing control unit 121) determines that the number of paper sheets T to be printed is smaller than or equal to the predetermined number (YES) and, when the number of paper sheets T exceeds four, determines that the number of paper sheets T to be printed is larger than the predetermined number (NO).

When block ST3 is YES, the control unit 120 (timing control unit 121) enters the second mode (block ST4), whereas when block ST3 is NO, the control unit 120 (timing control unit 121) enters the first mode (block ST5). In block ST6, the control unit 120 (timing control unit 121) controls the registration roller pair 34 in accordance with the mode the control unit 120 has entered, thus invoking the supply of the paper sheets T to the image forming unit 40 and the fixing unit 60 according to the timing associated with the entered mode. In other words, the control unit 120 starts printing on the paper sheets T (starts image formation on the paper sheets T).

As described above, when the number of paper sheets T to be printed immediately after the copier 1 is started up is smaller than or equal to the predetermined number, the control unit 120 (timing control unit 121) of the copier 1 according to the present embodiment enters the second mode. In the second mode, since the first paper sheet T is supplied to the fixing unit 60 in response to the temperature of the predetermined section on the surface of the heating rotating body 61 reaching the second temperature lower than the first temperature, the first paper sheet T can be supplied to the fixing unit 60 at a timing earlier than the first mode. When the number of paper sheets T to be printed immediately after the copier 1 is started up exceeds the predetermined number, the control unit 120 (timing control unit 121) of the copier 1 enters the first mode. In the first mode, the first paper sheet T is supplied to the fixing unit 60 in response to the temperature of the predetermined section on the surface of the heating rotating body 61 reaching the first temperature. Consequently, the temperature of the heating rotating body 61 can be maintained appropriately even when the paper sheets T are continuously supplied to the fixing unit 60 in constant time intervals. Thus, with the copier 1 according to the present embodiment, the amount of time required for fixing toner images on multiple paper sheets T can be reduced when only one paper sheet T is printed immediately after start-up as well as when multiple paper sheets T are printed in sequence immediately after start-up.

In the second mode, the control unit 120 (timing control unit 121) supplies, after the prescribed amount of time H2 elapses after the first paper sheet T has been supplied to the fixing unit 60, the second paper sheet T to the fixing unit 60. The prescribed amount of time H2 is greater than the prescribed amount of time H1 (which is equivalent to the time intervals of supplying paper sheets to the fixing unit 60 in the first mode). In this way, the copier 1 can fix toner images to the second and subsequent paper sheets T while being unaffected by the temperature drop of the surface of the heating rotating body 61 in the fixing unit 60, which is a greater temperature drop than that in the first mode and caused by supplying the first paper sheet T to the fixing unit 60 at an early timing in the second mode.

In the second mode, the control unit 120 (timing control unit 121) of the copier 1 gradually shortens the time intervals of supplying the third and subsequent paper sheets T to the fixing unit 60 (e.g., until the interval is equal or substantially equal to the time interval between sheets in the first mode). In this way, the copier 1 can print the third and subsequent paper sheets T, without increasing user frustration.

In this way, since the copier 1 according to the present embodiment can select one of two different modes on the basis of the number of paper sheets T to be printed immediately after start-up, the amount of time required for fixing toner images to the paper sheets T can be reduced even when multiple paper sheets T are printed in sequence immediately after start-up.

The present disclosure is not limited to the illustrative embodiment described above, and various modifications may be included in the scope of the disclosure.

In the copier 1 according to the present embodiment, immediately after the copier 1 is started up, the control unit 120 (timing control unit 121) enters the first mode when the print-copies information indicating the paper sheets T to be printed exceeds a predetermined number and enters the second mode when the print-copies information indicates a number smaller than or equal to the predetermined number. However, the present disclosure is not limited thereto. For example, in some embodiments, even if print-copies information indicating the paper sheets T to be printed immediately after the copier 1 is started up exceeds a predetermined number (for example, four), the control unit 120 (timing control unit 121) may control the registration roller pair 34 in the second mode until a specific number of paper sheets are printed and then after reaching a specific number may control the registration roller pair 34 in the first mode. In other words, in some embodiments, the second mode is entered immediately after the copier is started up, regardless of (independent of) the total number of paper sheets to be printed. Details of an illustrative processing flow according to some embodiments of such control will be illustrated in FIG. 5.

In block ST11, the control unit 120 turns on the power unit 80 (copier 1) from the power-off state in response to operating the power switch unit 70. At this time, the control unit 120 controls the power supply unit 110 to supply electric power to the heater unit 65.

In block ST12, the control unit 120 receives a printing instruction (image-formation instruction information) from the operating unit 90. Then, in block ST13, the control unit 120 (timing control unit 121) enters the second mode. At this time, the control unit 120 (timing control unit 121) controls the registration roller pair 34 and so on in the second mode and prints out the paper sheets T.

In block ST14, the control unit 120 (timing control unit 121) determines whether the number of printed paper sheets T is smaller than a predetermined number. At this time, when the number of printed paper sheets T is smaller than the predetermined number, the control unit 120 (timing control unit 121) determines that the number of printed paper sheets T is smaller than the predetermined number (YES) and controls the registration roller pair 34 and so on in the second mode to print out the paper sheets T. In contrast, when the number of printed paper sheets T is not smaller than a predetermined number (larger than or equal to the predetermined number), the control unit 120 (timing control unit 121) determines that the number of printed paper sheets T is not smaller than the predetermined number (NO) and proceeds to block ST15.

In block ST15, the control unit 120 (timing control unit 121) switches from the second mode to the first mode. At this time, the control unit 120 (timing control unit 121) controls the registration roller pair 34 and so on in the first mode to print out the paper sheets T.

Figure 5:
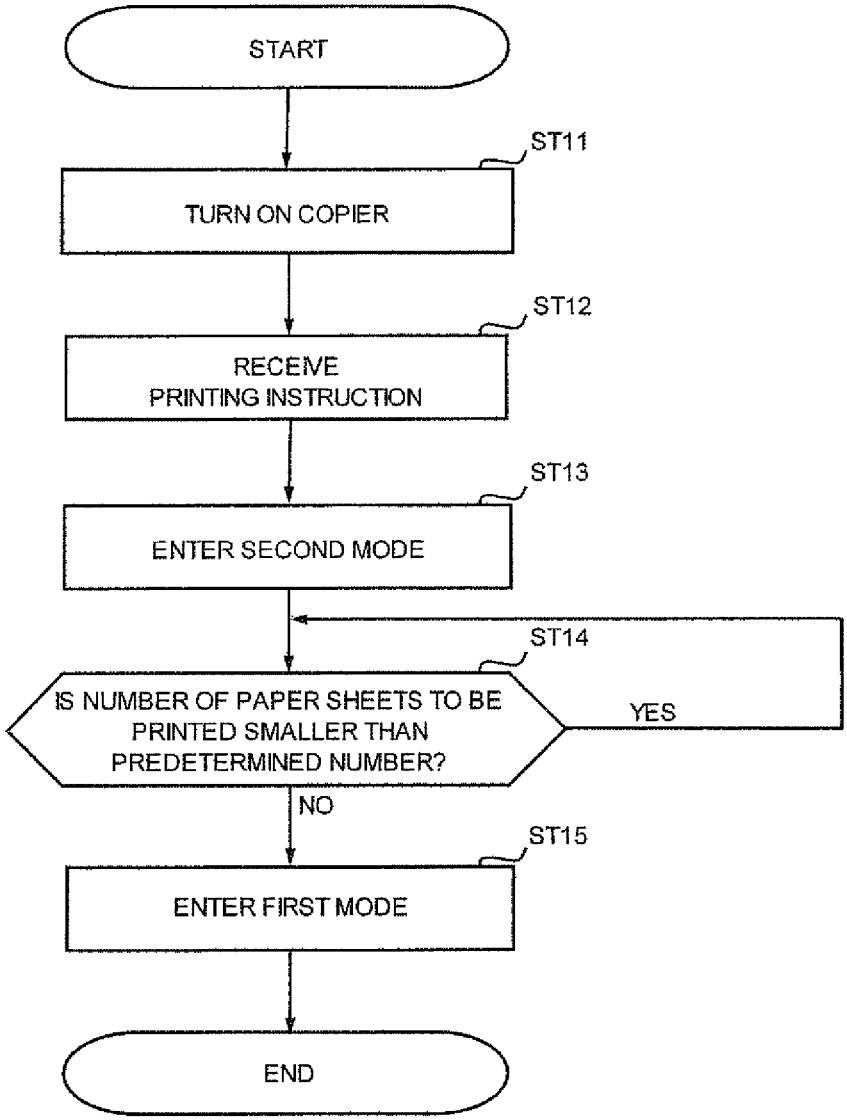
FIG. 5 is a flow chart illustrating another operation control of the copier, in accordance with some embodiments of the present disclosure.

Through such control illustrated in FIG. 5, the amount of time required to print the paper sheets T immediately after start-up can be reduced regardless of the number of paper sheets T to be printed.

The copier 1 of the present embodiments is a color copier. However, the copier 1 is not limited thereto and may instead be a monochrome copier.

The copier 1 of the present embodiments transfers toner images to the paper sheets T via the intermediate transfer belt 48 (indirect transfer). The copier 1, however, is not limited thereto and the toner images formed on the photoreceptor drums 41 may be directly transferred onto the paper sheets T (direct transfer).

The copier 1 of this embodiment carries out printing on one side of the paper sheets T. However, the copier 1 is not limited thereto and may carry out printing on both sides of a paper sheet T.

The image forming apparatus according to the present disclosure is not limited to the copier 1 described above. The image forming apparatus according to the present disclosure may be a multi-functional peripheral having a copier function, a facsimile function, a printer function, and a scanner function, or may be a facsimile or a printer.

The transfer materials on which toner images are fixed by the image forming apparatus according to the present disclosure is not limited to paper sheets and instead may be film sheets, such as overhead projector (OHP) sheets.

Having thus described in detail embodiments of the present disclosure, it is to be understood that the disclosure of the foregoing paragraphs is not to be limited to particular details and/or embodiments and/or illustrative variations thereof set forth in the above description, as many apparent variations thereof are possible without departing from the spirit or scope of the present invention.

What is claimed is:

1. An image forming apparatus comprising:

an image forming unit configured to form toner images on transfer materials;

a fixing unit configured to include a heating rotating body having a heater unit operable for heating the transfer materials and a pressurizing rotating body disposed adjacent to the heating rotating body with a fixing nip therebetween and being configured for pressing the transfer materials supplied through the fixing nip, the fixing unit being operable to fix the toner images formed at the image forming unit to the transfer materials by heating and pressing the transfer materials at the fixing nip;

a timing adjusting unit disposed upstream of the image forming unit in a conveying direction of the transfer materials and configured to adjust the timing of supplying the transfer materials to the fixing nip;

a temperature detecting unit configured to detect a temperature of a predetermined section of the heat rotating body;

a power supply unit configured to start or continue supplying electric power to the heater unit of the heating rotating body; and a timing control unit configured to control the timing adjusting unit, wherein, in the event that the power supply unit starts supplying electric power to the heater unit of the heating rotating body, the timing control unit is configured to select a first mode or a second mode in accordance with whether the number of transfer materials to be printed exceeds a predetermined number, the first mode for controlling the timing adjusting unit to supply a first transfer material when the temperature of the predetermined section of the heating rotating body detected by the temperature detecting unit exceeds a first temperature, the second mode for controlling the timing adjusting unit to supply the first transfer material when the temperature of the predetermined section of the heating rotating body detected by the temperature detecting unit exceeds a second temperature different from the first temperature.

2. The image forming apparatus according to claim 1, wherein the second temperature is lower than the first temperature.

3. The image forming apparatus according to claim 1, wherein the first mode is selected when the number of transfer materials to be printed exceeds the predetermined number, and the second mode is selected when the number of transfer materials to be printed is smaller than or equal to the predetermined number.

4. The image forming apparatus according to claim 1, wherein in the first mode, the timing control unit controls the timing adjusting unit to supply a second transfer material to the fixing nip after a first amount of time elapses from the moment the first transfer material has been supplied and to sequentially supply the third and subsequent transfer materials to the fixing nip every time the first amount of time elapses.

5. The image forming apparatus according to claim 1, wherein in the second mode, the timing control unit controls the timing adjusting unit to supply a second transfer material to the fixing nip after a second amount of time longer than a first amount of time elapses from the moment the first transfer material has been supplied.

6. The image forming apparatus according to claim 5, wherein in the second mode, the timing control unit controls the timing adjusting unit to gradually shorten the time intervals of supplying the third and subsequent transfer materials to the fixing nip.

7. An image forming apparatus comprising:

an image forming unit configured to form toner images on transfer materials;

a fixing unit configured to include a heating rotating body having a heater unit operable for heating the transfer materials and a pressurizing rotating body disposed adjacent to the heating rotating body with a fixing nip therebetween and being configured for pressing the transfer materials supplied through the fixing nip, the fixing unit being operable to fix the toner images formed at the image forming unit to the transfer materials by heating and pressing the transfer materials at the fixing nip;

a timing adjusting unit disposed upstream of the image forming unit in a conveying direction of the transfer materials and configured to adjust the timing of supplying the transfer materials to the fixing nip;

a temperature detecting unit configured to detect a temperature of a predetermined section of the heat rotating body;

a power supply unit configured to start or continue supplying electric power to the heater unit of the heating rotating body; and a timing control unit configured to control the timing adjusting unit, wherein the timing control unit is configured to select a first mode or a second mode to be enabled in the event that the power supply unit starts supplying electric power to the heater unit of the heating rotating body, the first mode for controlling the timing adjusting unit to supply a first transfer material when the temperature of the predetermined section of the heating rotating body detected by the temperature detecting unit exceeds a first temperature, the second mode for controlling the timing adjusting unit to supply the first transfer material when the temperature of the predetermined section of the heat rotating body detected by the temperature detecting unit exceeds a second temperature different from the first temperature, and wherein in the event that the number of transfer materials to be printed exceeds a predetermined number, the timing control unit controls the timing adjusting unit in the second mode up to the predetermined number of transfer materials and controls the timing adjusting unit in the first mode after the number of transfer materials exceeds the predetermined number.

8. The image forming apparatus according to claim 7, wherein the second temperature is lower than the first temperature.

9. The image forming apparatus according to claim 7, wherein in the first mode, the timing control unit controls the timing adjusting unit to supply a second transfer material to the fixing nip after a first amount of time elapses from the moment the first transfer material has been supplied after selecting the first mode and to sequentially supply the third and subsequent transfer materials to the fixing nip every time the first amount of time elapses.

10. The image forming apparatus according to claim 7, wherein in the second mode, the timing control unit controls the timing adjusting unit to supply a second transfer material to the fixing nip after a second amount of time longer than a first amount of time elapses from the moment the first transfer material has been supplied.

11. The image forming apparatus according to claim 10, wherein in the second mode, the timing control unit controls the timing adjusting unit to gradually shorten the time intervals of supplying the third and subsequent transfer materials to the fixing nip.

12. A method of forming an image using an image forming apparatus, the method comprising:

starting to supply electric power to a heater unit of a heating rotating body of a fixing unit that is operable to fix toner images onto transfer materials;

determining the number of transfer materials to be printed and whether the number of transfer materials is smaller than or equal to a predetermined number;

selecting between a first mode and a second mode based on whether the number of transfer materials exceeds the predetermined number, the first mode for controlling the timing of supplying a first transfer material being printed to the fixing unit when a temperature of a predetermined section of the heating rotating body exceeds a first temperature, the second mode for controlling the timing of supplying the first transfer material being printed to the fixing unit when the temperature of the predetermined section of the heating rotating body exceeds a second temperature different from the first temperature; and starting printing on the transfer materials by controlling the timing of supplying transfer materials to the fixing unit in accordance with the selected mode.

13. The method of forming an image according to claim 12, wherein the second temperature is lower than the first temperature.

14. The method of forming an image according to claim 12, wherein the first mode is selected when the number of transfer materials to be printed exceeds the predetermined number, and the second mode is selected when the number of transfer materials to be printed is smaller than or equal to the predetermined number.

15. The method of forming an image according to claim 12, wherein in the first mode, a timing control unit controls a timing adjusting unit to supply a second transfer material to the fixing unit after a first amount of time elapses from the moment the first transfer material has been supplied and to sequentially supply the third and subsequent transfer materials to the fixing unit every time the first amount of time elapses.

16. The method of forming an image according to claim 12, wherein in the second mode, the timing control unit controls the timing adjusting unit to supply a second transfer material to the fixing unit after a second amount of time longer than a first amount of time elapses from the moment the first transfer material has been supplied.

17. The method of forming an image according to claim 16, wherein in the second mode, the time intervals of supplying the third and subsequent transfer materials to the fixing unit are gradually shortened.

* * * * *